US005813153A

United States Patent [19]

Maglio

[11] Patent Number: 5,813,153

[45] Date of Patent: Sep. 29, 1998

[54] METHOD AND APPARATUS FOR TRACKING GARMENTS

[76] Inventor: Francesco Maglio, 567 Brownridge Drive, Thornhill, Ontario, Canada, L4J 6B6

[21] Appl. No.: 771,299

[22] Filed: Dec. 20, 1996

[51] Int. Cl.[6] ..... A44C 3/00

[52] U.S. Cl. ..... 40/1.6; 40/110; 40/661.04; 40/666; 283/2; 434/99; 434/395

[58] Field of Search ..... 40/1.5, 1.6, 107, 40/110, 586, 661.04, 666, 310; 283/2, 900; 434/99, 238, 395, 433

[56] References Cited

U.S. PATENT DOCUMENTS

| | | | |
|---|---|---|---|
| 3,561,066 | 2/1971 | Osteen | 40/1.5 X |
| 4,277,089 | 7/1981 | Lockhart | 282/27 R |
| 4,354,282 | 10/1982 | Langdon | 40/586 X |
| 5,031,937 | 7/1991 | Nellhaus | 283/900 X |
| 5,257,940 | 11/1993 | Schaarschmidt | 434/238 X |
| 5,393,100 | 2/1995 | Coe | 283/115 |
| 5,651,677 | 7/1997 | Hildebrandt | 434/99 |

*Primary Examiner*—Kenneth J. Dorner
*Assistant Examiner*—Andrea Chop
*Attorney, Agent, or Firm*—David W. Wong

[57] ABSTRACT

The method and device are for identifying and tracking garment and accessories in order to avoid repeating in wearing of the same garment and accessories to the same social function or occasion in its next occurrence. Distinctive identification devices are attachable to the garment and/or accessories after each function and the occasion is recorded either on such identification devices or in an associated recording device such that it can be ascertained that in the next occurrence of the same social function the same garment and accessories would not be worn again.

10 Claims, 2 Drawing Sheets

METHOD AND APPARATUS FOR TRACKING GARMENTS

BACKGROUND OF THE INVENTION

This invention relates to the method and device for identifying and tracking garment and/or accessories worn to particular social functions.

Many people, particularly those working in the hospitality industry and sale, dressing for various social occasions is very important in order to create a desirable image and social impression to clients, acquaintences and other people. There are many social functions which may be held in regular intervals or time and in which the same people may attend. Repeatedly wearing the same clothes to such social functions would inherently create a notion of thriftiness which may be detrimental to the personal image. Such happening may be avoided by having a large wardrobe; however, in most cases, the cost of acquiring a large wardrobe may be inhibitive and economically infeasible, and even for those having a large wardrobe, there is still the potentiality that the same garment may be unknowingly worn to the same function due to the lack of means of recalling or remembering what has been worn to a particular function previously.

SUMMARY OF THE INVENTION

It is a principal object of the present invention to provide a method for tracking the garment worn in all social functions.

It is another object of the present invention to provide a unique device for carrying out the method of tracking the garment and/or accessories worn.

It is another object of the present invention to provide a device which is simple in structure yet is effective in tracking the garment worn.

It is another object of the present invention to provide a device which would not cause damage or stain to the garment when attached thereto.

Briefly, the method of identifying and tracking a piece of clothing worn in a particular social occasion comprises of attaching an identification pin member on the piece of clothing following the attendance of a social function. The identification pin member has a plurality of identification tag members removably attached thereon. A tag member is then removed from the identification pin member and is attached to a recording calendar. The recording calendar has a plurality of designated areas therein identifying dates of the year, and each designated area includes an attachment area therein adapted to receive the tag member to be mounted thereon and an information recording area adapted to record the social occasion attended.

BRIEF DESCRIPTION OF THE DRAWINGS

Other objects and advantages of the present invention will become apparent from the following detailed description of the preferred embodiments thereof in connection with the accompanying drawings, in which.

DETAILED DESCRIPTION OF THE PREFERRED EMBODIMENTS

Figure 1:
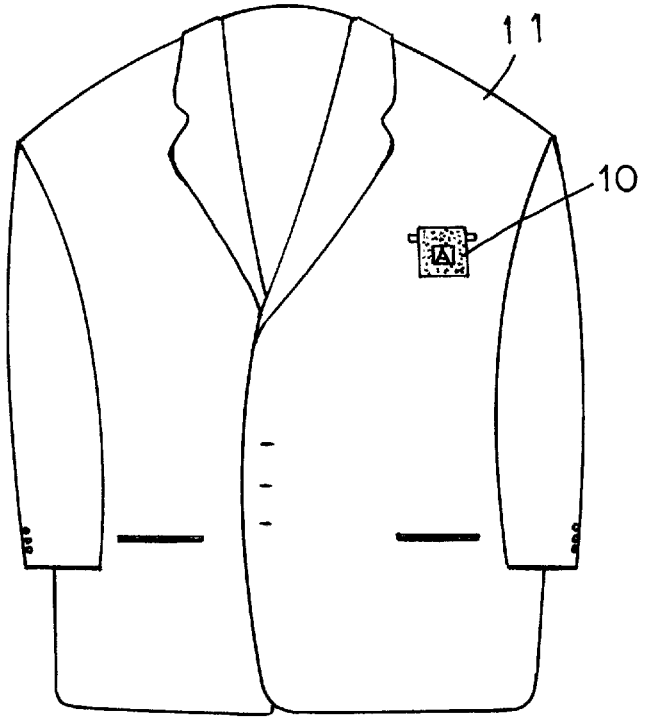
FIG. 1 is a perspective elevation view showing attachment of an identification pin to a garment according to the present invention.
Figure 2:
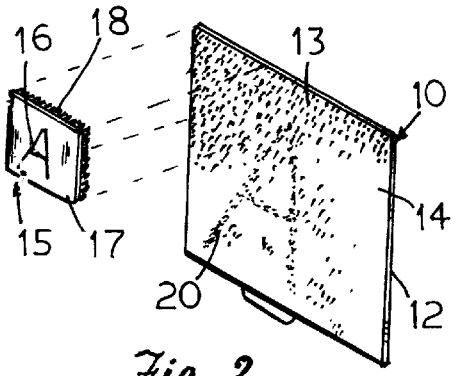
FIG. 2 is a front perspective elevation view of the identification pin and the removable tag thereof.
Figure 3:
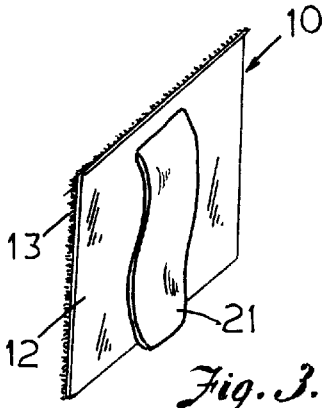
FIG. 3 is a rear perspective elevation view of the identification pin according to the present invention showing the slip-on mounting arm provided thereon.
Figure 4:
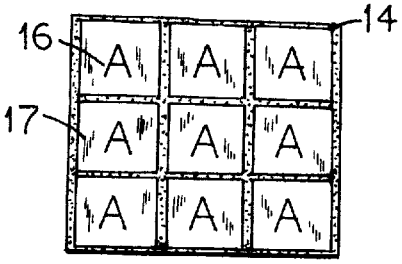
FIG. 4 is a front elevation view of the identification pin with the removable tags mounted thereon.
Figure 5:
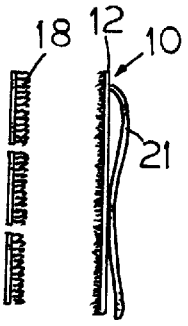
FIG. 5 is a side perspective elevation view of the identification pin and the removable tags.

With reference to the drawings wherein like reference numerals designate corresponding parts in the several views, the identification pin 10 according to the present invention is attached to a garment 11 such as at its pocket as best shown in FIG. 1, for tracking the date on which it was worn. The identification pin 10 has a body 12 with a fuzzy material 13 such as a woolly fabric provided on its front surface 14. A plurality of identification tags 15 having an identification symbol 16 provided on their front surface 17. The identification symbol may be a distinctive mark such as a letter "A" as shown in the example in the illustration, or a color mark. A plurality of clinging hook-shaped fibers 18 such as a VELCRO (trademark) material are provided on the back surface of the tags so that the tags 15 may be removably attached to the front surface 14 of the identification pin 10 by pressing their back surface 18 with the plurality of clinging fibers 18 of the VELCRO material to adhere with the fuzzy material 13. It can be appreciated by those skilled in the art that other adhering means such as temporary adhesive or other mechanical mounting means may be provided between the tags 15 and the identification pin for removably mounting the tags on the latter. An associated identification symbol 20 or color mark identical to that of the identification symbol or color mark 16 may also be provided on the surface of the fuzzy material 13 such that when all the tags 15 are removed from the identification pin 10 the associated identification symbol or mark 20 will become visible. Such provision facilitates the identification of the pin and its associated tags when they are separated. A spring-like slip-on clasp arm 21 is provided on the back of the identification pin 10 for easy mounting of the pin to the garment. The body 11 of the identification pin and the spring-like clasp arm 21 may be integrally formed by a molding process with a plastic material. It can be appreciated by those skilled in the art that various other types of mounting means such as a spring-biassed clip may be used for the same purpose. However, the slip-on clasp arm 21 is preferred due to its simplicity of construction and production, and that in use it would not cause any damage to the garment.

Figure 6:
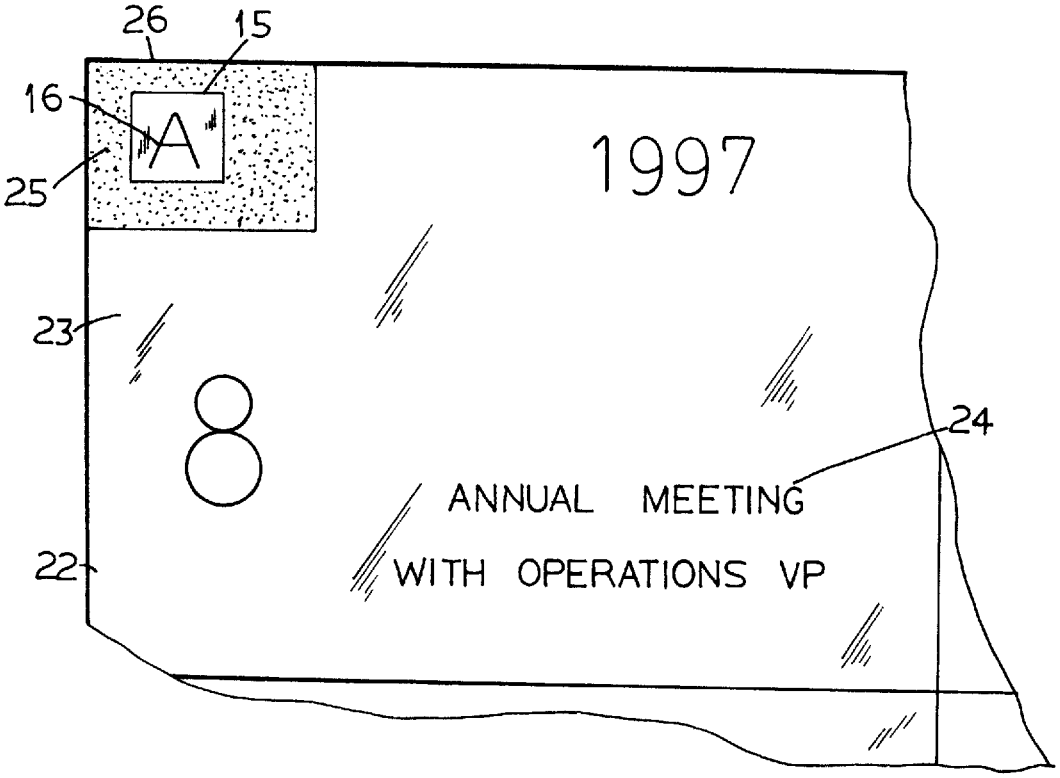
FIG. 6 is an enlarged isolated elevation view of the recording area of the recording calendar according to the present invention with the removable tag attached to the tracking area and the event recorded on the recording area therein.

A recording calendar 22 is provided for recording the dates of occurrence of the events or occasions. The recording calendar 22 may be of a single sheet or having separate twelve sheets similar to a conventional calendar with each single sheet representing a single month of the year. Each sheet of the calendar has a date tabulation similar to a conventional calendar with rectangular designated areas 23 representing each day of the month as best shown in the isolated view in FIG. 6. The sheet of the recording calendar may be made of a plastic material such that information 24 may be written thereon with erasable ink. Alternatively, the sheet may be made of other sheet material with a plastic coating provided thereon. A fuzzy material covering 25 is provided in a tracking area 26 in each designating area 24 showing the date. The fuzzy material covering 25 is similar to the fuzzy material 13 provided on the identification pin 10, such that a tag 15 after having been removed from the identification pin 10, may also be removably attached to a selected tracking area 26 as shown in FIG. 6.

Following the attendance to a particular function, an identification pin 10 is attached to the main garment 11, such as a jacket, worn to the function; identification tags 15 are then removed from the identification pin and attached to the other clothes such as a pair of slacks, the overcoat and sweater which were also worn to the same occasion. A tag 15 is also attached to the tracking area of the particular designated area 24 on the recording calendar to mark the date on which the ensemble of clothing was worn, and the information 24 indicative of the occasion is recorded with erasable ink on the recording area as best shown in FIG. 6. Any unused tag 15 may remain attached to the identification clip 10 and one tag 15 can always be intentionally left attached to the identification pin 10 in order to ascertain its identification in addition to the same identification mark 20. A plurality of identification pins having different identification marks or appearances are provided for use with the variety of clothes worn to different occasions in this manner so that the same pieces of clothing would not be worn again to the same occasion.

While the preferred embodiments of the invention have been described above. It will be recognized and understood that various modifications may be made therein and the appended claims are intended to cover all such modifications which may fall within the spirit and scope of the invention. For example, various decorative forms and arrangements may be incorporated in the identification clip to provide more attractiveness, and it can also be made of metal or similar material. Furthermore, a recordable area may be provided on the identification pin such that the information of the occasion attended may be directly recorded on the identification pin.

I claim:

1. A method of identifying and tracking a piece of clothing worn in a particular social occasion, comprising attaching an identification pin member on said piece of clothing, said identification pin member having a plurality of identification tag members removably attached thereon, removing one tag member of said identification tag members from said identification pin member and attaching said one tag member to a recording calendar which has a plurality of designated areas therein identifying dates of the year, and each one of said designated areas having an attachment area adapted to receive said one tag member to be mounted thereon and an information recording area adapted for recording therein said social occasion attended.

2. A method of identifying and tracking pieces of clothing worn in a particular social occasion, comprising attaching a removable identification pin member to a selected one of said pieces of clothing, said identification pin member having a plurality of identification tag members removably attached thereon, and said tag members having an identical appearance, removing a selected number of said identification tag members from said identification pin member and attaching each one of said tag members to each other ones of said pieces of clothing worn to said social occasion with said one of said pieces of clothing, attaching one of said tag members to a tracking area in a recording calendar which has a plurality of designated areas identifying dates of the year, and each one of said designated areas having said tracking area provided therein adapted to receive said one of said tag members for attaching thereon, and each one of said designated areas having a recording area therein adapted for recording said social occasion attended.

3. A method of identifying and tracking pieces of clothing according to claim 2 wherein all of said identification tag members have an identical identification symbol provided thereon.

4. A method of identifying and tracking pieces of clothing according to claim 2 wherein all of said identification tag members have an identical appearance.

5. An apparatus for identifying and tracking pieces of clothing worn in various functions, comprising an identification pin member having a main body and an attachment member provided on said main body, said attachment member being operative for removably attaching said identification pin member to a piece of clothing, said identification pin member having a front surface provided with an attachment material, a plurality of tag members in which each tag member has an identical appearance and has an associated attachment material provided on its rear surface, said associated attachment material being cooperative with said attachment material provided on said identification pin member for removably attaching said tag members to said front surface of said identification pin member, and said associated attachment material being operative for removably attaching said tag members to pieces of clothing worn to said social occasion, a recording calendar member having a plurality of designated areas therein with dates of the year marked thereon, and each designated area having an information recording area and a tracking area, said recording area being operative for recording thereon said social occasion, said tracking area having an attachment material provided thereon whereby a selected tag member is removably attachable thereon;

wherein said attachment material is a fuzzy fabric material, and said associated attachment material has a plurality of hook-shaped clinging fibers therein operative for attaching to said fabric material removably.

6. An apparatus according to claim 5 wherein all of said tag members have a similar front surface with an identical symbol provided thereon.

7. An apparatus according to claim 6 wherein said attachment member on said identification pin member is a slip-on arm formed on said identification pin member, said slip-on arm being operative for attaching said identification pin member to a piece of clothing.

8. An apparatus according to claim 7 wherein said attachment member is a spring clip provided on said identification pin member.

9. An apparatus according to claim 8 wherein said tag members have an identical appearance.

10. An apparatus according to claim 9 wherein said recording area of said recording calendar is coated with a plastic material adapted for information to be written thereon with erasable ink.

* * * * *